US010618707B2

(12) United States Patent
Straughan

(10) Patent No.: US 10,618,707 B2
(45) Date of Patent: Apr. 14, 2020

(54) CHILD RESISTANT SNUFF CONTAINER

(71) Applicant: Swedish Match North Europe AB, Stockholm (SE)

(72) Inventor: Simon Straughan, Newcastle (GB)

(73) Assignee: Swedish Match North Europe AB, Stockholm (SE)

( * ) Notice: Subject to any disclaimer, the term of this patent is extended or adjusted under 35 U.S.C. 154(b) by 0 days.

(21) Appl. No.: 15/761,790

(22) PCT Filed: Jan. 18, 2017

(86) PCT No.: PCT/EP2017/050931
§ 371 (c)(1),
(2) Date: Mar. 20, 2018

(87) PCT Pub. No.: WO2017/125405
PCT Pub. Date: Jul. 27, 2017

(65) Prior Publication Data

US 2018/0319556 A1 Nov. 8, 2018

(30) Foreign Application Priority Data

Jan. 18, 2016 (SE) ..... 1650051

(51) Int. Cl.
*B65D 50/06* (2006.01)
*A24F 23/00* (2006.01)
(Continued)

(52) U.S. Cl.
CPC ..... *B65D 50/061* (2013.01); *A24F 23/00* (2013.01); *B65D 43/0212* (2013.01);
(Continued)

(58) Field of Classification Search
CPC ..... B65D 50/046; B65D 50/045; B65D 2215/04; B65D 2251/04; B65D 43/02;
(Continued)

(56) References Cited

U.S. PATENT DOCUMENTS 4,444,326 A 4/1984 Musel
2007/0284372 A1* 12/2007 Gnepper ..... B65D 43/0227 220/4.21

(Continued)

OTHER PUBLICATIONS

International Search Report for International Application No. PCT/EP2017/050931 dated Mar. 10, 2017.

*Primary Examiner* — Anthony D Stashick
*Assistant Examiner* — L Kmet
(74) *Attorney, Agent, or Firm* — Knobbe Martens Olson & Bear LLP

(57) ABSTRACT

A snuff container (101), comprising a base part (102) and a closure part (103) and being provided with a locking arrangement (120) for locking the closure part on the base part (102). The base part (102) comprises a bottom wall (105), a base side wall (107) and a compartment wall (117) arranged inward of the base side wall (107) with a space (114) between the base side wall (107) and the compartment wall (117). A portion of the base side wall (107) is formed by a resiliently flexible tongue (133), with an upper part of the tongue (133) being inwardly deflectable in a direction towards the compartment wall (117). The locking arrangement (120) comprising a first locking member (122) is arranged on an upper part (135) of the resiliently flexible tongue (133) and a second locking member (123) is arranged on the closure part (103) at a closure side wall end edge (113). The locking arrangement (120) is arranged to assume a locked configuration and a release configuration in which the upper part (135) of the resiliently flexible tongue (133) is in an inwardly deflected position.

13 Claims, 5 Drawing Sheets

(51) Int. Cl.
*B65D 43/02* (2006.01)
*B65D 83/06* (2006.01)

(52) U.S. Cl.
CPC ..... *B65D 83/06* (2013.01); *B65D 2215/04* (2013.01); *B65D 2251/04* (2013.01)

(58) Field of Classification Search
CPC ..... B65D 83/06; B65D 50/061; A24F 23/00; Y10S 206/80
USPC ..... 220/281, 253; 206/253, 1.5; 132/305; 215/206
See application file for complete search history.

(56) References Cited

U.S. PATENT DOCUMENTS

| | | | | |
|---|---|---|---|---|
| 2008/0124954 | A1 | 5/2008 | Wei Chen | |
| 2009/0283437 | A1 | 11/2009 | Angelucci et al. | |
| 2011/0186579 | A1 | 8/2011 | Bailey et al. | |
| 2014/0262870 | A1* | 9/2014 | Sims ..... | A24F 23/00 206/265 |

* cited by examiner

CHILD RESISTANT SNUFF CONTAINER

CROSS REFERENCE TO RELATED APPLICATIONS

This application is a U.S. National Phase Application of PCT International Application Number PCT/EP2017/050931, filed on Jan. 18, 2017, designating the United States of America and published in the English language, which is an International Application of and claims the benefit of priority to Swedish Patent Application No. 1650051-4, filed on Jan. 18, 2016. The disclosures of the above-referenced applications are hereby expressly incorporated by reference in their entireties.

TECHNICAL FIELD

The disclosure pertains to a snuff container, comprising a base part and a closure part, a snuff storage compartment having an access opening being arranged in the base part, the closure part being arranged to open and close the access opening, the snuff container comprising a locking arrangement for locking the closure part on the base part.

BACKGROUND

Orally used smokeless tobacco products and non-tobacco products, referred to herein as "snuff" or "snuff products" are generally packaged in small handy containers, each container being designed to contain several portions of unused snuff and optionally including a disposal compartment for temporary storage of used snuff. The containers are pocket sized and may be carried by a user in a pocket or a handbag until all the fresh snuff products packaged in the container have been used after which the emptied container may be discarded and replaced with a new container with unused snuff products. As snuff products may be hazardous to children, it has been proposed to provide snuff containers with child safety arrangements in order to make the containers difficult to open by a child. A partly conflicting demand on a child safety arrangement for a snuff container is that the container should be user friendly and convenient to open and close also by an adult having reduced manual dexterity and hand strength.

It is an object of the present invention to offer a snuff container which is child resistant but which can be readily opened by an adult having reduced manual capacity.

SUMMARY

The above objects may be achieved with a snuff container as disclosed herein.

As disclosed herein, there is offered a snuff container comprising an improved child safety arrangement, in accordance with appended claim 1. Further embodiments are set out in the dependent claims.

The disclosure relates to a snuff container, comprising a base part and a closure part, a snuff storage compartment having an access opening being arranged in the base part, the closure part being arranged to open and close the access opening, the snuff container comprising a locking arrangement for locking the closure part on the base part. The snuff container is distinguished by:

the base part comprises a bottom wall, the bottom wall having a peripheral edge and a base side wall extending from the peripheral edge of the bottom wall and terminating in a base side wall end edge, the base part further comprising a compartment wall arranged inward of the base side wall and at a distance from the base side wall with a space between the base side wall and the compartment wall;

the closure part comprises a top wall having a peripheral edge and a closure side wall, the closure side wall extending from the peripheral edge of the top wall towards the bottom surface and terminating in a closure side wall end edge;

a portion of the base side wall comprises a resiliently flexible tongue, the resiliently flexible tongue having a lower part at the bottom wall and upper part, the upper part of the resiliently flexible tongue being inwardly deflectable in a direction towards the compartment wall; and the locking arrangement comprises a first locking member being arranged at the upper part of the resiliently flexible tongue and a second locking member being arranged on the closure part at the closure side wall end edge, the first and second locking members being mating locking members and being arranged to be in mating engagement with each other in a locked configuration of the locking arrangement wherein the resiliently flexible tongue is aligned with adjacent parts of the base side wall and to be free from engagement with each other in a release configuration of the locking arrangement wherein the upper part of the resiliently flexible tongue is in an inwardly deflected position in relation to the adjacent parts of the base side wall.

The resiliently flexible tongue arranged in the base side wall is disconnected from the adjacent portions of the base side wall at least at the upper part of the resiliently flexible tongue allowing the upper part of the resiliently flexible tongue to be flexed inwardly in relation to adjacent portions of the base side wall. The resiliently flexible tongue may be separated from the adjacent portions of the base side wall by any type of discontinuity in the base side wall such as slits or cut-outs extending from the base side wall end edge downwards towards the peripheral edge of the bottom wall. The slits or cut-outs may terminate a short distance above the bottom wall whereby the resiliently flexible tongue is connected to the adjacent base side wall portions at the lower part of the resiliently flexible tongue. Such connections may be the only connections between the resiliently flexible tongue and the remaining parts of the base part. Alternatively, the slits or cut-outs may extend all the way to the bottom wall and a connection between the lower part of the resiliently flexible tongue and the bottom wall may be the only connection between the resiliently flexible tongue and the remaining parts of the base part. The discontinuities in the base side wall may be formed at the same time as forming the base part, e.g. by injection molding, or may be formed in a separate production step by removal of material from the base side wall, for instance by cutting or milling. To adjust the force needed to depress the resiliently flexible tongue, discontinuities in the form of slits or cut-outs may be partially closed by means of a thin membrane at the lower end of the discontinuity, i.e. at the end closest to the bottom wall.

One or more breakable connecting element may be arranged to connect the upper part of the resiliently flexible tongue with one or both of the adjacent portions of the base side wall prior to a first opening of the snuff container. The breakable connecting element or elements may be provided as tamper evidence on a new snuff container.

The bottom wall of the base part may be an unbroken wall delimited by the peripheral edge. Alternatively, the bottom wall may comprise separate bottom wall parts which together form the bottom wall. By way of example, a central part of the bottom wall may be constituted by a bottom wall of the storage compartment and a peripheral part of the bottom wall may be constituted by a sealing ring, which is applied to cover a gap corresponding to the space between the base side wall and the compartment wall. The bottom wall may comprise a disposal compartment for temporary storage of used snuff portions and a cover to close the disposal compartment. The bottom wall may be profiled or may be planar or substantially planar.

In analogy with the bottom wall of the base part, the top wall of the closure part may be an unbroken wall delimited by the peripheral edge of the closure part. Alternatively, the top wall may comprise separate top wall parts which together form the top wall. Such separate parts may, for instance, be a central part constituted by a cover over a disposal compartment and peripheral parts surrounding a disposal compartment. The top wall may be profiled or may be planar or substantially planar.

The base side wall has a lower part which is visible from the outside when the snuff container is closed and an upper part which is concealed inside the closure side wall when the snuff container is closed.

A locking arrangement on the snuff container as disclosed herein is operated by pressing the resiliently flexible tongue inwards such that the upper part of the resiliently flexible tongue is moved in a direction towards the compartment wall. An inwardly directed force acting on the resiliently flexible tongue causes the resiliently flexible tongue to bend about the fixed lower end. Thereby, the upper part of the resiliently flexible tongue, which carries the first locking member is deflected inwardly and brings the first locking member out of engagement with the second locking member. When the first and second locking members are disengaged from each other, the locking arrangement has been brought to the release configuration. The snuff container can only be opened by removing the closure part when the locking arrangement is in the release configuration.

The first and second locking members may be arranged facing each other. The first locking member may be arranged at the free edge of the resiliently flexible tongue such that the first locking member protrudes outwardly from the resiliently flexible tongue, in a direction away from the storage compartment. In a circular snuff container, the first locking member protrudes outwardly in the radial direction of the snuff container. The second locking member may be arranged protruding in the opposite direction, i.e. inwardly from the closure side wall edge. The first and second locking members may take the form of ridges having any suitable profile allowing engagement between the locking members. When the closure part with the second locking member is pressed downward onto the base part, the locking member on the inside of the closure part moves over the first locking member on the outside of the resiliently flexible tongue and snaps into locking engagement with the first locking member. The mating profiles of the first and second locking members are preferably selected such that the locking members cannot be disengaged by simply pulling the closure part away from the base part without using excessive or even destructive force. Preferably, the second locking member is hooked together with the first locking member in the locked configuration of the locking arrangement.

The snuff container may be provided with supplemental snap-in closure elements at parts of the periphery which do not coincide with a resiliently flexible tongue. Such supplemental snap-in closure elements may form auxiliary parts of a locking arrangement as disclosed herein, or may be provided as closure elements in addition to locking members provided for use in a locking arrangement as disclosed herein. The supplemental snap-in closure elements may be arranged to require application of a disengagement force when pulling the container parts away from each other after the locking arrangement has been brought to the release configuration, or may be arranged to require alignment with a corresponding release member, as set out herein. By way of example, a supplemental closure element may be provided as a bead extending along the closure side wall end edge, on the inside of the closure side wall. The bead may be continuous or discontinuous and may be arranged to cooperate with the first locking member or with a separate supplemental locking member on the base part. It is generally preferred that the bead is dimensioned such that it can be disengaged from the corresponding closure element on the base part by simply pulling the closure part away from the base part when the locking arrangement is in the release configuration. Generally, the bead protrudes a smaller distance from the closure side wall than the second locking member or members.

The terms up, down, top, bottom, upwards, downwards, inwards and outwards, etc. as used herein refer to the directions of a snuff container when rested with the bottom wall on a horizontal surface. The upward direction is the direction toward the top wall of the snuff container, the downwards direction is the direction towards the bottom wall of the snuff container, the inward direction is the direction towards the storage compartment and the outwards direction is the direction towards the ambient, i.e. away from the storage compartment.

A flexible component, as used herein, is a component which may be bent or flexed by manual force. A resilient component is a component which may be deformed by application of a force but which will fully or at least substantially return to its non-deformed state as soon as the force is removed. A resiliently flexible component will flex back to its non-flexed position when the flexing force ceases. The resiliently flexible tongue on the snuff containers as disclosed herein will flex back into alignment with the adjacent portions of the base side wall as soon as the application of an inwardly acting pressure on the resiliently flexible tongue is ceased. One or both of the first and second locking members may be resiliently deformable in order to facilitate bringing the locking arrangement into the locked position. In addition, or as an alternative, the base side wall may be resiliently deformable. Furthermore, the deformability of the resiliently flexible tongue contributes to provide convenient closure of the snuff container and may even provide sufficient deformability to allow the first locking member to become engaged with the second locking member.

The compartment wall which is arranged inward of the base part side wall forms a sideways or lateral limitation of the storage compartment in the base part. The compartment wall is preferably a continuous wall without interruptions or holes in order to ascertain that the packaged snuff product in the compartment is shielded from the environment when the snuff container is closed such that the snuff product is kept fresh for a prolonged period of time The storage compartment is further delimited by the bottom wall or part of the bottom wall and by the top wall or part of the top wall of the closure part when the snuff container is closed.

The first and second mating locking members may comprise or consist of snap-in closure elements which permit the snuff container to be closed and locked by pressing together the closure part with the base part. As set out herein, suitable mating locking members which may also provide a snap-in function is interengaging ridges or other interengaging profiles.

In a snuff container as disclosed herein, wherein the first and the second mating locking members comprise or consist of interengaging ridges, a circumferential extension of a coextensive portion of the first and the second locking members in a release position of the locking arrangement is preferably smaller than or equal to an extension of the upper free edge of the resiliently flexible tongue which means that pushing the resiliently flexible tongue inwards will cause the first and the second locking members to be completely disengaged from each other.

Although a single locking arrangement may suffice to provide the snuff container with appropriate child resistance, optionally in combination with an additional closure arrangement as set out herein, it may be preferred that the snuff container comprises first and second locking arrangements forming a pair of locking arrangements. The pair of locking arrangements may be placed with the individual locking arrangements spaced apart along a circumference of the snuff container such that they may be conveniently gripped and operated simultaneously with one hand using the other hand to remove the closure part from the base part. Alternatively, the snuff container may be opened by setting the base part and the closure part in a release position, pressing only one of the resiliently flexible tongues inwards to disengage the locking members and removing the closure part by tilting it upward, away from the disengaged locking members. Upward tilting of the closure part at the released locking arrangement causes the locking members at the opposite locking arrangement to become disengaged and allows the closure part to be fully removed from the snuff container. As set out herein, removal of the closure part from the base part may require application of a pulling force to disengage supplemental closure elements, which may be provided on the snuff container.

It may be preferred that the first and second locking arrangements are placed at opposing locations along the circumference of the snuff container such that they may be simultaneously operated while gripping the base part between the thumb and a finger of one hand and squeezing the resiliently flexible tongues towards each other. In a snuff container having cylindrical shape, the first and second locking arrangements may be placed diametrically opposite each other.

A snuff container as disclosed herein may have any desired circumferential shape. It may be preferred that the snuff container has a cylindrical or generally cylindrical shape with a circular circumference and has an axial direction and a radial direction perpendicular to the axial direction.

In a snuff container as disclosed herein and having a generally circular circumference, the closure part may be arranged to be rotatable in relation to the base part when the snuff container is closed with the closure part attached to the base part. The closure part can preferably be freely rotated on the base part in both directions, i.e. clockwise and anti-clockwise, which means that the connection between the closure part and the base part does preferably not comprise a threaded connection. The snuff container is arranged to remain closed and with the locking arrangement in the locked configuration with the locking members coupled to each other in all rotational positions of the closure part in relation to the base part. The locking arrangement can only be transferred from the locked configuration to the release configuration at one or more select release positions along the circumference of the snuff container. A release position is a position in which the closure part and the base part are arranged relative to each other such that the first and second locking members are in locking engagement but can be disengaged, i.e. unlocked by pushing one or more resiliently flexible tongue inwards. If the closure part and the base part are not in a release position, they can be moved to a release position by relative rotation between the parts.

A snuff container as disclosed herein and having generally circular cross-sectional shape with a closure part and a base part having interengaging locking means in the form of mating ridges is opened by rotating the parts such that they are set in a release position. When the parts are in the release position, the resiliently flexible tongue can be pushed inwards to disengage the locking members, thereby transferring the locking arrangement to the release configuration. When the closure part and the base part have been moved into the release position, nothing prevents the resiliently flexible tongue from being pushed inwards such that the co-extensive parts of the first and second locking members can be disengaged from each other. In a snuff container comprising more than one resiliently flexible tongue bearing a locking member which cooperates with a mating locking member on the closure part, the snuff container is provided with one release position for each resiliently flexible tongue. The multiple release positions are arranged with a circumferential distribution which allows all resiliently flexible tongues on the base part to be simultaneously brought to a release position. If more release positions are provided than the number or resiliently flexible tongues, it is preferred that each of the multiple release positions allows all of the provided resiliently flexible tongues to be operable. The release position or release positions may be marked by alignment means such as one or more of arrows, lines, mating pattern elements, or similar, placed on the closure part and on the base part.

The closure part of a snuff container as disclosed herein may comprise a blocking member which is arranged to prevent the resiliently flexible tongue from moving into the space between the base side wall and the compartment wall except when the resiliently flexible tongue is in a predetermined and preferably selectable release position on the circumference of the snuff container, the release position corresponding to a position of a second locking member on the closure part. The blocking member may take the form of one or more blocking flanges arranged on the inside of the top wall and extending from the inside of the top wall downward into the space between the base side wall and the compartment wall. When the snuff container is closed with the closure part applied on the base part the restriction in the space between the base side wall and the compartment wall caused by the blocking member prevents inward deflection of the resiliently flexible tongue to a position in which the first and the second locking members become disengaged.

In addition to being located on a resiliently flexible tongue, the first locking member on a snuff container as disclosed herein may extend as an outwardly protruding ridge along the base side wall end edge also in parts of the base side wall which are not constituted by a resiliently flexible tongue. The first locking member may be provided with one or more interruptions along the base side wall end edge, the extension of an interruption being equal to or greater than an extension of one or more supplementary locking member(s) arranged along the closure side wall end edge. The interruption in the first locking member may be sized to prevent a second locking member from passing through the interruption if the supplementary locking member or members is not a second locking member. In this way, the second locking member cannot pass out of engagement with the first locking member at any location along the circumference of the snuff container except at a selected release position where the second locking member is aligned with a resiliently flexible tongue.

A supplementary locking member may alternatively be an auxiliary second locking member. By way of example, a cylindrical snuff container having a pair of opposing resiliently flexible tongues on the base part may be provided with two pairs of second locking members on the closure part, as set out herein. The second locking members are equidistantly spaced on the inside of the closure side wall such that any one of the two pairs of second locking members may be aligned with the pair of resiliently flexible tongues. Bringing the base part and the closure part into a release position will in such case require the parts to be rotated at most a quarter of a full rotation. When the base part and the closure part have been brought to a release position, the pair of second locking members which has not been aligned with the pair of resiliently flexible tongues is automatically decoupled from the first locking member for instance by being aligned with an interruption in the first locking member.

Each locking arrangement comprises a resiliently flexible tongue with a first locking member on the base part of the snuff container and a second locking member arranged on the closure part. In a snuff container as disclosed herein and being provided with more than one locking arrangement, the first locking member may be the first locking member of all locking arrangements and may be constituted by a ridge extending circumferentially along the base side wall end edge, with first parts of the first locking member arranged on the resiliently flexible tongues at the upper ends of the resiliently flexible tongues and with second parts of the first locking member arranged between the resiliently flexible tongues. The first and second parts of the first locking member are separated by discontinuities in the first locking member corresponding to the discontinuities in the base side wall delimiting the resiliently flexible tongues. The first parts of the first locking member are the parts that can be brought out of engagement with the second locking member. The second parts of the first locking member are non-movable and cooperate with one or more second locking members to keep the snuff container closed with the closure part on the base part when the closure part and the base part are not set in a release position.

In a snuff container as disclosed herein, an interruption in the first locking member may be sized and positioned to allow passage through the interruption of a supplementary locking member arranged on the closure part at the closure side wall end edge only when the closure part and the base part is in the release position.

The snuff container as disclosed herein and having generally circular shape may be provided with a greater number of second locking members than a number of corresponding first locking members. It may be preferred that four second locking members are arranged equidistantly spaced on the inside of the closure part along the circumference of a snuff container comprising two oppositely placed locking arrangements. Thereby, the second locking members form first and second pairs of opposing second locking members. When one pair of second locking members is aligned with the corresponding first locking members on the resiliently flexible tongues, the other pair of second locking members is aligned with corresponding interruptions in the ridges forming the second parts of the first locking member. The interruptions in the second parts of the first locking member are sized and positioned to allow passage through the interruptions of the pair of second locking members which is not aligned with the resiliently flexible tongues.

The snuff containers as disclosed herein may have a generally cylindrical shape with circular peripheral edges on the bottom surface and the top surface. The primary function of a snuff container as disclosed herein is to contain fresh ready-to-use snuff products. Accordingly, the bottom surface and the top surface may be disc shaped or have a modified disc shape, such as a non-planar disc shape. Non-planar disc shapes as used herein include profiled shapes comprising embossed or raised profile elements such as figurative elements and/or functional elements. Figurative elements may be symbols, letters, patterns, etc. and functional elements may be stacking elements, a recess for used snuff products, etc.

In the closed configuration of a snuff container as disclosed herein, which may also be referred to as the connected configuration of the snuff container, the closure part is attached to the base part and covers the access opening of the snuff storage compartment.

Opening of a snuff container as disclosed herein requires that it is first ascertained that the closure part and the base part are in a release position. Thereafter, the locking members are disengaged from each other by pushing on one or more resiliently flexible tongues thereby allowing the closure part to be removed from the base part. The resiliently flexible tongue appears at first glance to be a conventional push-button. However, in contrast to a conventional push-button, the release function of the locking arrangement as disclosed herein is triggered only when applying pressure to the upper part of the resiliently flexible tongue and not by pressing centrally on resiliently flexible tongue as is the normal way of operating a conventional push-button. Consequently, a child trying to open a snuff container as disclosed herein must first figure out that resiliently flexible tongue operates differently from a conventional push-button. Secondly, the child must realise that the resiliently flexible tongue must be held in the deflected release configuration in order to be able to remove the closure part. An attempt at un-locking the snuff container by pressing centrally or at the lower part of the resiliently flexible tongue will fail, as pressure applied at the lower half of the resiliently flexible tongue will generally not produce sufficient lever force to cause the resiliently flexible tongue to bend at the lower end. Thus, by providing a snuff container with a locking arrangement as disclosed herein, the likelihood that a child is able to open the snuff container may be considerably reduced. The force required to manipulate the resiliently flexible tongue may be adjusted to an appropriate level by selecting a material having a desired flexure resistance. The flexure resistance in the resiliently flexible tongue may be varied by varying the goods thickness, by providing the resiliently flexible tongue with a live hinge zone, etc. Suitable materials for the base part may be thermoformable plastic materials or metal.

Further locking arrangements may be provided to increase the level of child resistance. An upper limit for the number of locking arrangements may be 5, one for each finger of a hand. However, increasing the number of locking arrangements above two may make the snuff container less user friendly and more difficult to open for adults having impaired manual capacity. As a container which is difficult to open by an adult user is less likely to be properly closed after having been opened, user friendliness and ease of opening by an adult reduces the risk of a child gaining access to the contents in a snuff container which has been left open.

As set out herein, the snuff storage compartment in the base part is delimited by an inner compartment wall which extends from the bottom wall inward of the base side wall and at a distance from the base side wall. The compartment wall terminates in a compartment wall end edge which may be arranged at the same height as the base side wall end edge or above or below the side wall end edge. The base side wall and the compartment wall may extend parallel to each other in the height direction of the snuff container. The compartment wall may have a height which is greater than a height of the base side wall. Accordingly, the compartment wall may protrude above the base side wall in the height direction which means that the compartment wall may extend into the closure part when the snuff container is in the closed configuration. When in the closed configuration of the snuff container, the compartment wall may extend past the side wall end edge of the closure part all the way to the top surface of the closure part, or only a part of the distance from the side wall end edge to the top surface of the closure part.

When the snuff container is closed, the end edge of the closure side wall is preferably in direct contact with a receiving ledge on the outer surface of the base side wall. The closure part is preferably sized and configured to provide a tight fit against the base part such that the dividing line formed between the end edge of the closure part and the ledge on the base part is as invisible as possible. The dividing line may divide the container in two equal parts or may be off-set towards the top or towards the bottom, i.e. the height of the part of the base side wall which is visible from the outside may be greater or smaller than the height of the closure side wall.

A base part having a greater height than the closure part may be preferred as it may provide the base part with greater storage capacity. A closure part having a lesser height than the base part may also be used to signal to a user that the closure part is a lid and should be directed upwards when opening the container.

The width of the resiliently flexible tongue may be from 13 mm to 25 mm, such as from 15 mm to 20 mm. The width of the resiliently flexible tongue should preferably be sufficiently large to accommodate a finger of an adult.

In a snuff container as disclosed herein, the bottom wall or the top wall may comprise a recess and a reclosable cover arranged to close the recess. The recess may serve as a compartment for temporary storage of used snuff portions and may be smaller than the snuff storage compartment.

The reclosable cover may comprise a snap-in closure arrangement.

The snuff containers as disclosed herein are consumer packages having a shape and a size adapted for conveniently carrying the package in a pocket or in a handbag and may be used for packaging any known type of snuff product.

The terms "snuff" and "snuff product" are used herein to refer to any kind of smokeless tobacco products and non-tobacco products for oral use.

A non-tobacco snuff product may be any composition as known in the art for use in the oral cavity and may comprise plant material other than tobacco material, cellulose such as microcrystalline cellulose, fillers, flavorants, and active ingredients such as nicotine, caffeine, etc.

Smokeless tobacco for oral use includes chewing tobacco, dry snuff and moist (wet) snuff. Generally, dry snuff has moisture content of less than 10 wt % and moist snuff has a moisture content of above 40 wt %. Semi-dry products having between 10% to 40 wt % moisture content are also available.

Smokeless tobacco products for oral use are made from tobacco leaves, such as lamina and stem of the tobacco leaf. The material from roots and stalks are normally not utilized for production of smokeless tobacco compositions for oral use.

There are two types of moist snuff, the American type and the Scandinavian type which is also called snus. American-type moist snuff is commonly produced through a fermentation process of moisturized ground or cut tobacco. Scandinavian-type moist snuff (snus) is commonly produced by using a heat-treatment process (pasteurization) instead of fermentation.

Both the American-type and the Scandinavian-type of moist snuff for oral use are available in loose form or portion-packed in a saliva-permeable, porous wrapper material forming a pouch. Pouched moist snuff, including snus, is typically used by the consumer by placing the pouch between the upper or lower gum and the lip and retaining it there for a limited period of time.

By "tobacco" is meant any part, e.g., leaves, stems, and stalks, of any member of the genus *Nicotiana*. The tobacco may be whole, shredded, threshed, cut, ground, cured, aged, fermented, or otherwise, e.g., granulated or encapsulated.

"Oral" and "oral use" is in all contexts used herein as a description for use in the oral cavity, such as buccal placement.

As used herein "pouched smokeless tobacco product for oral use" or "oral pouched smokeless tobacco product" refers to a portion of smokeless tobacco packed in a saliva-permeable pouch material intended for oral use.

BRIEF DESCRIPTION OF THE DRAWINGS

The present invention will be further explained hereinafter by means of non-limiting examples and with reference to the appended drawings wherein.

DETAILED DESCRIPTION

It is to be understood that the drawings are schematic and that individual components, are not necessarily drawn to scale. The child resistant snuff container shown in the figures is provided only as an example and should not be considered limiting to the invention. Accordingly, the scope of the invention is determined solely by the appended claims.

Although the snuff container shown in the figures is a cylindrical snuff container having circular cross section it is to be understood that the locking arrangement as disclosed herein can be arranged on a snuff container having non-circular cross section, such as rectangular, near-rectangular, oval or the like. A cylindrical snuff container wherein the closure part and the base part are arranged such that they can be rotated in relation to each other to set the closure arrangement in a release position may be preferred as it requires two sequentially performed manipulations to allow the closure arrangement to become disconnected.

Furthermore, the snuff container may be provided with a disposal compartment for temporary storage of used snuff portions. Such disposal compartment may be arranged in the closure part or in the base part, as is known in the art.

Figure 1:
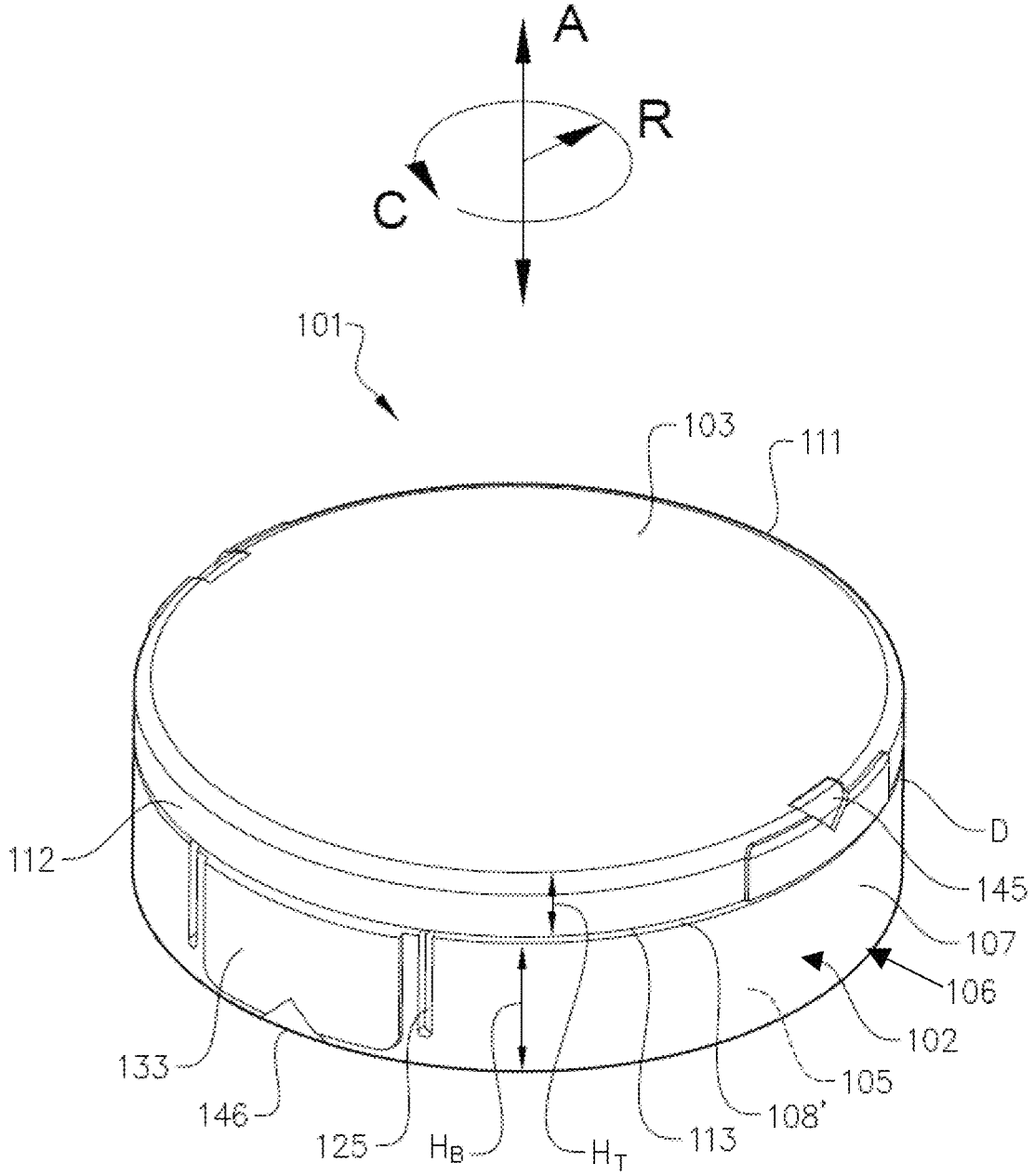
FIG. 1 shows a perspective view of a snuff container seen from above.
Figure 6:
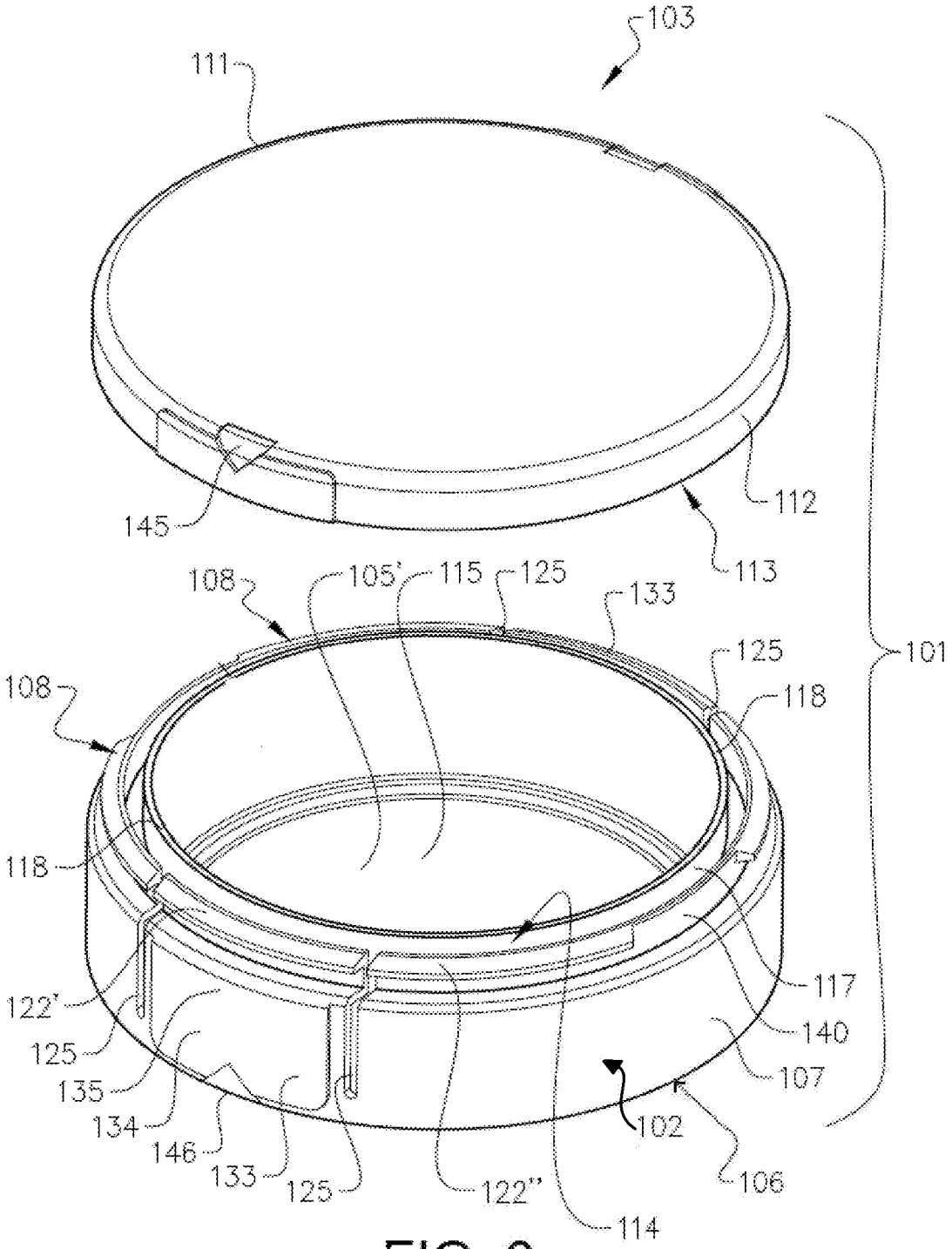
FIG. 6 shows the snuff container in FIG. 1 in an open position.

The snuff container 101 shown in FIG. 1 comprises a base part 102 and a closure part 103. The snuff container 101 is shown in FIG. 1 in a closed position with the closure part 103 closed and locked on the base part 102 and is shown in FIG. 6 in an open position with the closure part 103 removed from the base part 102.

As indicated in FIG. 1, the closed circular snuff container 101 has an axial direction A coinciding with a vertical direction when the snuff container is placed with the base part 102 on a horizontal surface, a radial direction R coinciding with a horizontal direction when the snuff container 101 is placed with the base part 102 on a horizontal surface, the radial direction R being perpendicular to the axial direction A, and a circumferential direction C.

Figure 3:
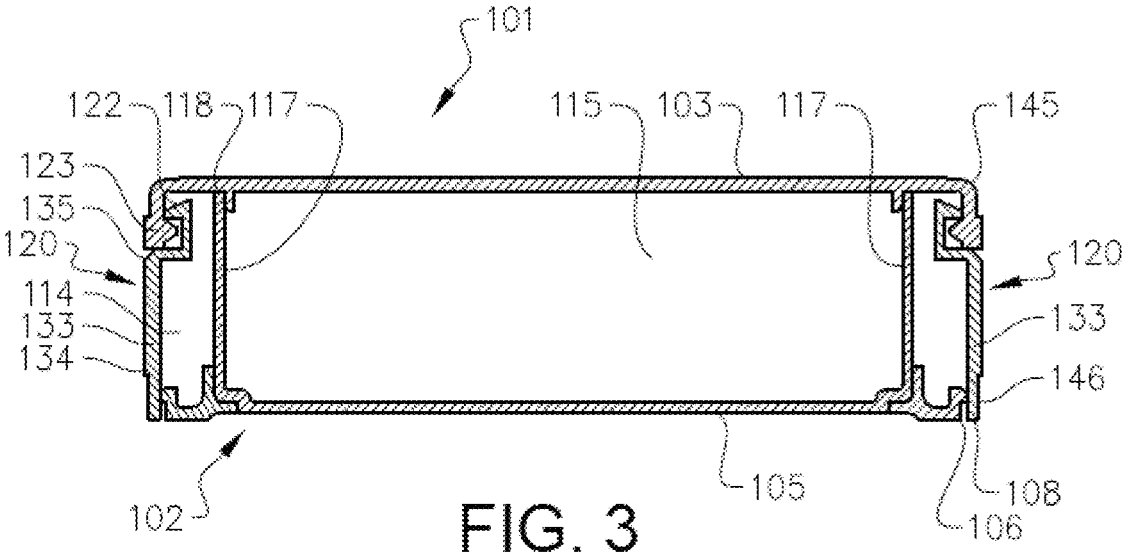
FIG. 3 shows a cross-section through the snuff container in FIG. 2, taken along the line III-III.

The base part 102 comprises a bottom wall 105 having a peripheral edge 106 and a base side wall 107 extending from the peripheral edge 106 of the bottom wall 105 in the axial direction A and terminating in a base side wall end edge 108 as seen in FIG. 3.

Figure 2:
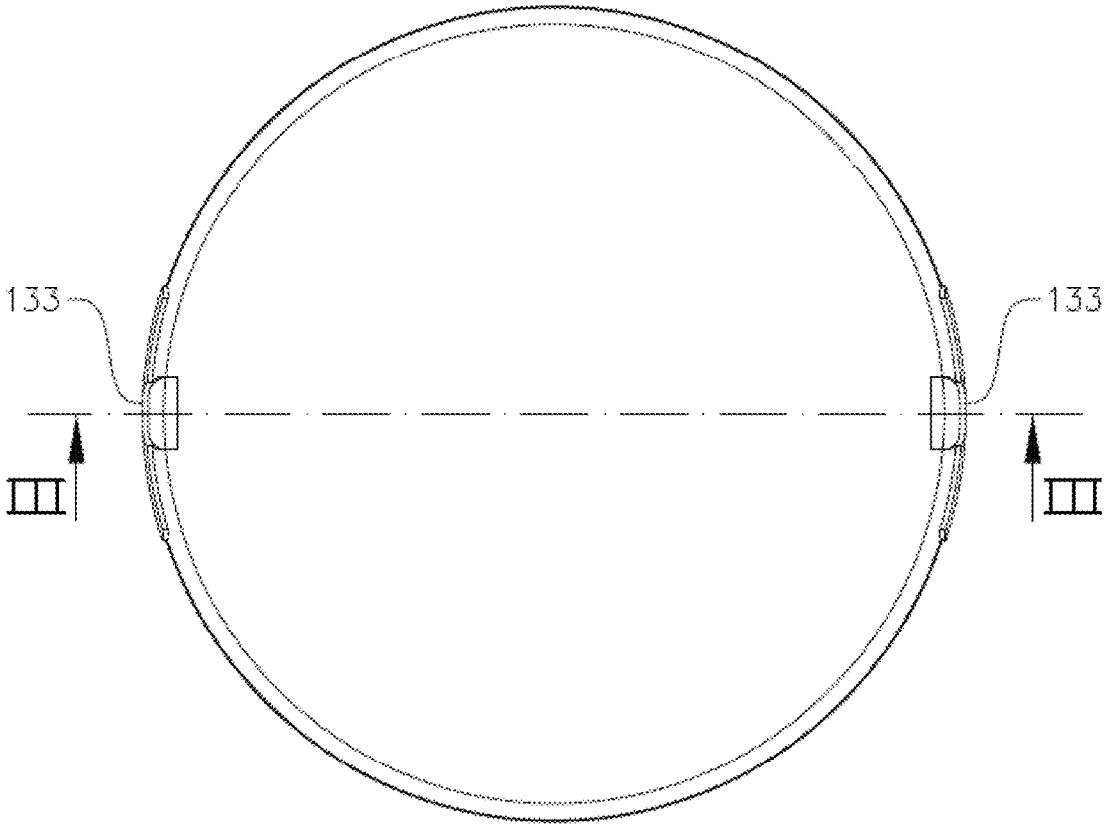
FIG. 2 shows a top view of the snuff container in FIG. 1 in a release position.

Two opposing portions of the base side wall 107 are formed by two resiliently flexible tongues 133 as is illustrated in FIG. 2 and FIG. 3. The resiliently flexible tongue 133 has a lower, fixed end 134 at the bottom wall 105 and an upper, free end 135 which free end has an edge forming part of the base side wall end edge 108. The resiliently flexible tongue 133 is arranged so that it can be inwardly deflected about the lower end 134. As can be seen in FIG. 6, the upper ends of the resiliently flexible tongues 133 are separated from the adjacent portions of the base side wall 107 by discontinuities 125 in the base side wall 107 which are shown as slits from the base side wall end edge 108 downwards towards the peripheral edge 106 of the bottom wall 105. The slits terminate at a distance from the peripheral edge 106 of the bottom wall 105. In this manner, the resiliently flexible tongues 133 are hingedly connected to the remaining parts of the base side wall 107 at the lower ends 134 of the resiliently flexible tongues 134 such that the upper ends 135 of the resiliently flexible tongues 133 may be moved inwards into the snuff container 101, without affecting the remaining parts of the base side wall 107.

The closure part 103 comprises a top wall 110 having a peripheral edge 111 and a closure side wall 112 which extends from the peripheral edge 111 of the top surface 110 towards the bottom wall 105 in the axial direction A of the closed snuff container 101 and which terminates in a closure side wall end edge 113.

The base side wall 107 has a lower part which is visible from the outside when the snuff container is closed and an upper part which is concealed inside the closure side wall 112 when the snuff container 101 is closed. When the snuff container is closed, the closure side wall end edge 113 abuts against a peripheral ledge 108' on the outside of the base side wall 107.

Figure 7:
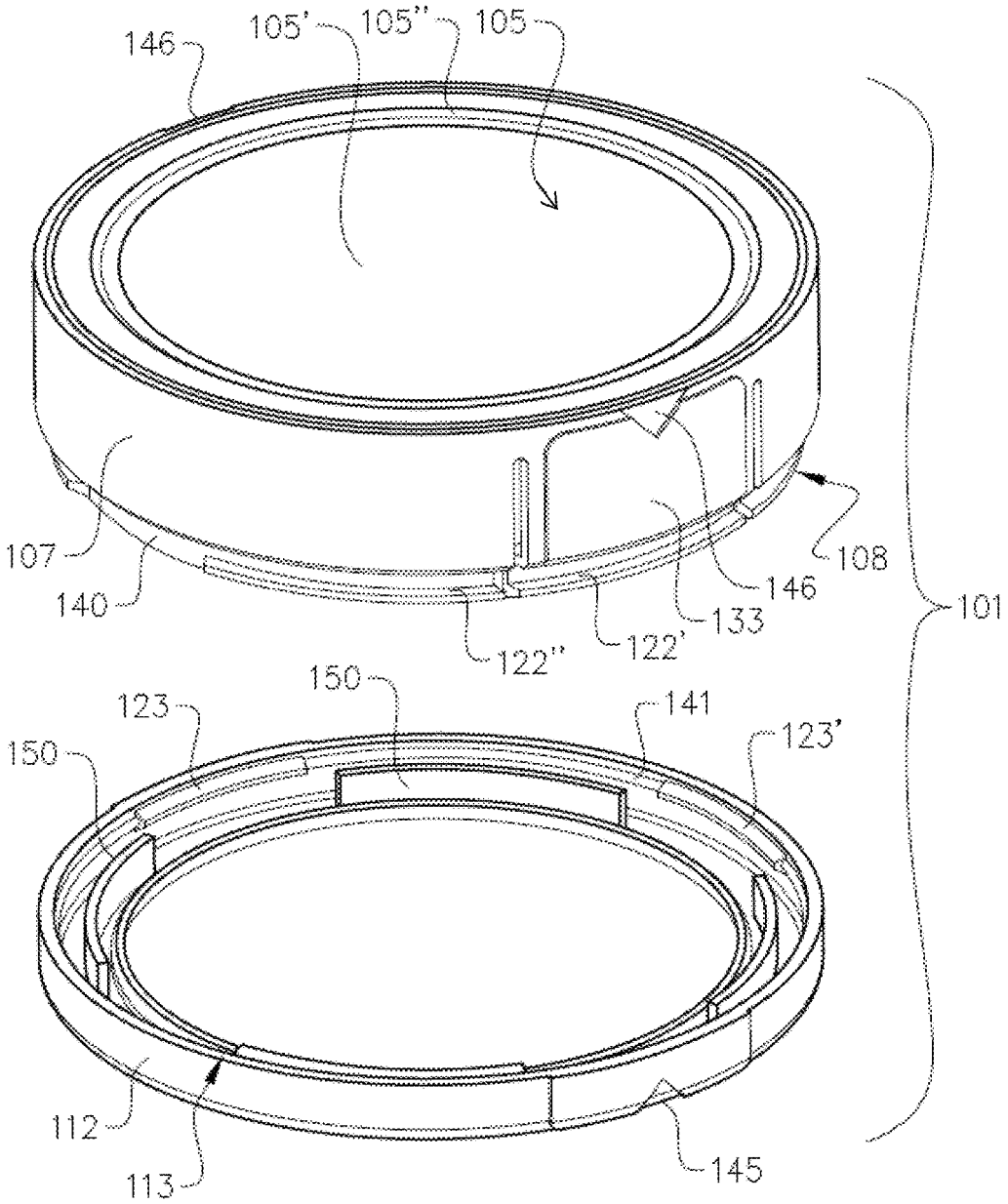
FIG. 7 shows the snuff container in FIG. 1 seen from below and in an open position.

The bottom wall 105 of the base part may be an unbroken wall delimited by the peripheral edge 106. Alternatively, the bottom wall 105 may comprise separate bottom wall parts which together form the bottom wall. As shown in FIG. 7, a central part of the bottom wall 105 may be constituted by a bottom wall 105' of the storage compartment 115 and a peripheral part of the bottom wall 105 may be constituted by a sealing ring 105", which is applied to cover a gap corresponding to the space 114 between the base side wall 107 and a compartment wall 117. The sealing ring 105" is an optional component of the snuff container 101.

The snuff storage compartment 115 is delimited in the radial direction, R, by a compartment wall 117 which extends from the bottom wall 105 of the base part 102 parallel to the base side wall 107 at a distance from the base side wall 107 in the radial direction R such that a space 114 is formed between the base side wall 107 and the compartment wall 117. The compartment wall 117 terminates in a compartment wall end edge 118. The height of the compartment wall 117 is shown in the figures to be the same as the height of the base side wall 107. As set out herein, such arrangement is optional and the snuff container may be provided with a compartment wall 117 being higher or lower than the base side wall 107. In a closed snuff container 101, the compartment wall end edge 118 abuts against the inner surface of the top wall 110, as is shown in FIG. 3. In this manner, the compartment 115 is effectively sealed and the contents inside the compartment 115 may be kept fresh for a prolonged time. The inner closure of the snuff container is optional to the invention as disclosed herein.

The snuff container 101 is provided with two locking arrangements 120 for locking the closure part 103 on the base part 102.

The locking arrangements 120 are placed diametrically opposite each other in the radial direction R of the snuff container 101, as is seen e.g. in FIG. 2.

The provision of paired locking arrangements is optional to a snuff container as disclosed herein. Accordingly, the snuff container may be provided with only a single locking arrangement or with up to five locking arrangements spaced apart in the circumferential direction C allowing the locking arrangements to be simultaneously operated by the fingers on one hand. When providing three or more locking arrangements, the locking arrangements may be located in the base side wall with equal spacing in the circumferential direction C or being spaced apart to provide convenient gripping positions for an adult size hand.

Figure 4:
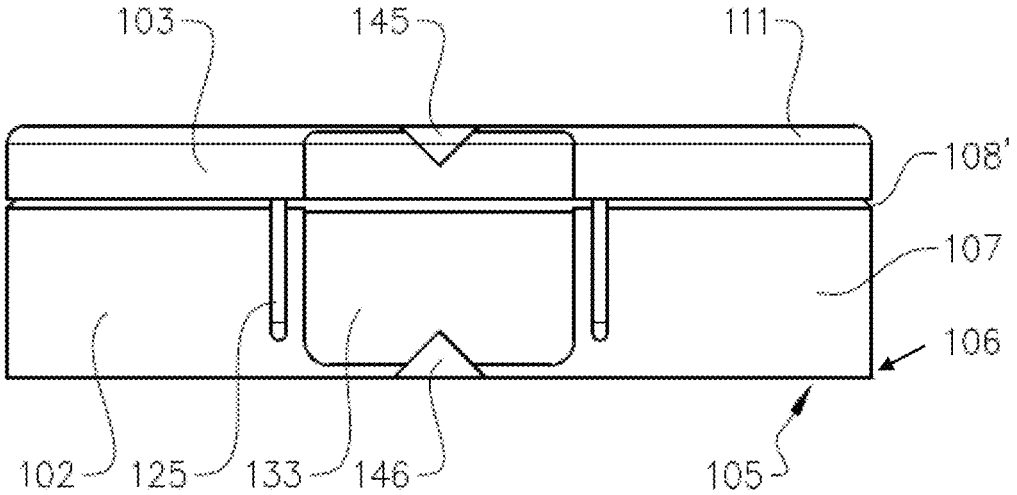
FIG. 4 shows a side view of the snuff container in FIG. 1.

Each locking arrangement comprises a first locking member 122 and a second locking member 123. In the embodiment which is shown in the figures, the first locking member 122 is constituted by a ridge extending circumferentially along the base side wall end edge 108 and being the first locking member 122 of both locking arrangements. The first locking member 122 comprises first parts 122' arranged on the resiliently flexible tongues 133 at the upper ends 135 of the resiliently flexible tongues 133 and second parts 122" arranged between the resiliently flexible tongues 133 and being separated from the first parts 122' by the discontinuities 125 in the base side wall 107. The second locking members 123 are arranged on the inside of the closure part 103 at the closure side wall end edge 113, as can be seen in FIGS. 3 and 7. The first and second locking members 122, 123 are mating locking members and are arranged to be in mating engagement with each other in a locked configuration of the locking arrangement wherein the resiliently flexible tongues 133 are aligned with adjacent parts of the base side wall 107 as is illustrated in FIGS. 1, 4 and 6 and to be free from engagement with each other in a release configuration of the locking arrangement wherein the resiliently flexible tongues 133 are in an inwardly tilted position in relation to the adjacent parts of the base side wall 107.

A snuff container as disclosed herein may be provided with a greater number of second locking members 123 than the number of first locking members 122. In the non-limiting example shown in the figures, two second locking members 123 are arranged opposite each other on the inside of the closure part 103 along the circumference of the snuff container 101 as is seen in FIG. 7. The second locking members 123 form a pair opposing second locking members. When the pair of second locking members 123 is aligned with the corresponding first locking members 122 on the resiliently flexible tongues 133, a pair of auxiliary locking members 123' is aligned with corresponding interruptions 140 in the ridges forming the second parts 122" of the first locking member 122. The interruptions 140 in the second parts 122" of the first locking member 122 are sized and positioned to allow passage through the interruptions of the pair of auxiliary locking members. In the illustrated embodiment, the interruptions 140 in the second parts 122" of the first locking member 122 and the auxiliary locking members 123' have smaller extension in the circumferential direction C than the extension of the resiliently flexible tongues 133 in the circumferential direction C. Thereby, the second locking members 123 cannot pass through the interruptions 140 and can only be disconnected from the first locking member when aligned with the resiliently flexible tongues 133. The snuff container may, thus, be opened in two rotational positions of the closure part in relation to the base part.

Alternatively, the second locking members 123 and the auxiliary locking members 123' may be of equal size and may form first and second pairs of opposing second locking members. When any one of the pairs of second locking members is aligned with the resiliently flexible tongues 133, the other pair of second locking members 123 is aligned with corresponding release members 140 formed as interruptions in the ridges forming the second parts 122" of the first locking member 122. The release members 140 in the second parts 122" of the first locking member 122 are sized and positioned to allow passage through the interruptions of the auxiliary pair of second locking members which is not aligned with the resiliently flexible tongues 133. The snuff container may, thus, be opened in any of four rotational positions of the closure part in relation to the base part.

With reference again to FIG. 1, the closure side wall end edge 113 and the ledge 108' on the outside of the base side wall 107 meet at a dividing line D when the snuff container 101 is closed. The dividing line D extends circumferentially around the snuff container 101 and may be arranged at a distance from the bottom surface 105 in the axial direction A of from 30% to 70% of a combined height $H_B+H_T$ of the visible part of the base side wall 107 and the closure side wall 112, such as from 50% to 70% of said combined height $H_B+H_T$ of the visible part of the base side wall 107 and the closure side wall 112.

Figure 5:
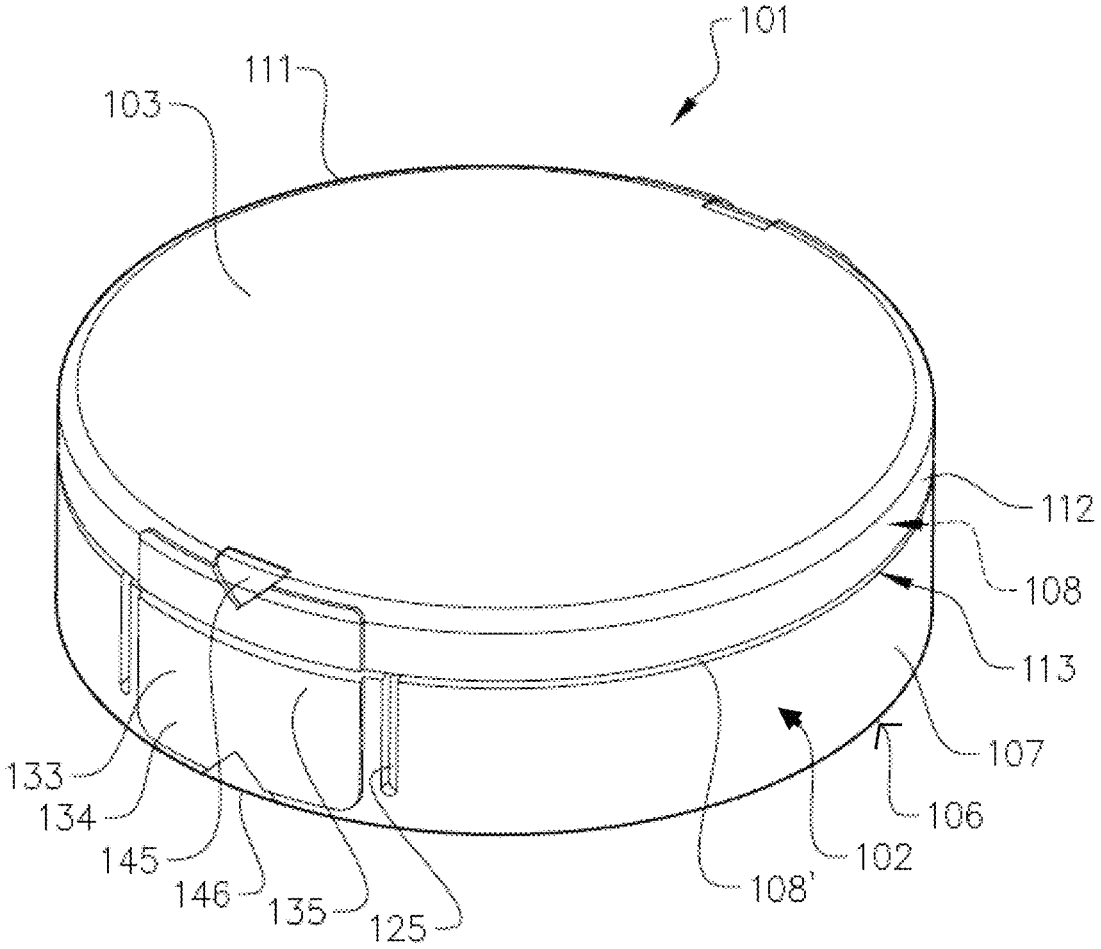
FIG. 5 shows the snuff container in FIG. 1 in a release position.

The snuff container 101 is opened by rotating the closure part 103 and the base part 102 in relation to each other such that they are set in a release position, with the resiliently flexible tongues 133 aligned with one pair of second locking members 123. In order to aid a user to readily identify the release position, the snuff container 101 may be provided with alignment means. In the illustrated example, the alignment means is provided by a triangular cut-out 145 on the closure part 103 and a corresponding triangular cut-out 146 on the base part 102 and by mating parts of a raised pattern which parts together form a rectangle indicating the position of the resiliently flexible tongue 133. The alignment means signal that a release position has been reached when the triangular cut-outs 145, 146 are aligned with each other and the parts of the raised pattern form a single rectangle, as shown in FIG. 5. The triangular cut-outs shown in the figures are only offered as one example of useful alignment means, and it is to be understood that other alignment means may be used such as arrows, lines, dots, etc. Without limitation, the alignment means may be inset into the goods of the snuff container, as the cut-outs shown in the figures, may form a relief on the surface of the snuff container as the rectangles shown in the figures, or may be printed or embossed on the container or on a label attached to the container. The alignment means on the closure part may be arranged on the top wall 110, on the side wall 112, or both. In the illustrated embodiment, one pair of alignment means is shown, indicating the location of the pair of second locking members 123 on the outside of the closure part 103. In a snuff container having a symmetrical paired arrangement of resiliently flexible tongues 133 and corresponding paired second locking members 123 it is sufficient to mark out the location of only one of the second locking members 123. Alignment of one of the second locking members in a pair of second locking members 123 with a resiliently flexible tongue automatically brings the opposing second locking member 123 into alignment with the opposing second resiliently flexible tongue 133. In a snuff container having more than one release position, alignment means may be provided for all release positions.

After alignment of the first and second locking members 122, 123 with each other, as is shown in FIG. 3, the upper part of the resiliently flexible tongues 133 can be pushed inward, towards the storage compartment 115 to transfer each locking arrangement 120 to the release configuration by moving the first part 122' of the first locking member 122 into the space 114 between the compartment wall 117 and the base side wall 107 and out of engagement with the second locking member 123. In a release position of the base part 102 and the closure part 103, the resiliently flexible tongues 133 can be pushed inwardly the full distance between the compartment wall 117 and the base side wall 107. In order to decouple the closure part 103 from the base part 102, both locking arrangements 120 need to be manipulated to the release configuration at the same time, i.e. the resiliently flexible tongues 133 need to be simultaneously pressed inwardly.

As shown in FIG. 7, a supplemental closure element 141 may be provided e.g. in the form of a bead extending along the closure side wall end edge 113, on the inside of the closure side wall 112. The bead is arranged to cooperate with the first locking member 122 and is dimensioned such that it can be disengaged from the first locking member 122 the base part by simply pulling the closure part away from the base part when the locking arrangement 120 is in the release configuration, with the resiliently flexible tongues 133 pressed inwardly and the first locking members disengaged from the second locking members 123. Generally, the bead protrudes a smaller distance from the closure side wall 112 than the second locking member or members 123 or any auxiliary locking member 123'.

The supplemental closure element 141 is optional to the snuff containers as disclosed herein such that no engagements are present between the closure part 103 and the base part when the locking arrangements 120 are in the release position as the pair of auxiliary locking members 123' is simultaneously brought into alignment with the interruptions 140 in the second parts 122" of the first locking member 122.

When the locking arrangements 120 are not in a release position, e.g. as is shown in FIG. 1, the resiliently flexible tongues 133 are prevented from moving into the space 114 between the compartment wall 117 and the base side wall 107 by blocking members 150 which are arranged on the inside of the top wall 110 of the closure part 103. The blocking members 150 are shown as blocking flanges which extend from the inside of the top wall downward into the space 114 between the base side wall 107 and the compartment wall 117. When the snuff container 101 is closed with the closure part 103 applied on the base part 102 the restriction in the space 114 between the base side wall 107 and the compartment wall 117 caused by the blocking member prevents inward tilting of the resiliently flexible tongue to a position in which the first and the second locking members 122', 123 become disengaged.

The child safety locking arrangements as disclosed herein may be applied to other types of containers requiring child proofing, such as containers for house-hold chemicals, pharmaceuticals, etc.

The invention claimed is:

1. A snuff container, comprising a base part and a closure part, a snuff storage compartment having an access opening being arranged in said base part, said closure part being configured to open and close said access opening, said snuff container comprising a plurality of locking arrangements for locking said closure part on said base part, wherein said snuff container has a generally circular outer circumference and has an axial direction and a radial direction perpendicular to said axial direction, said base part comprises a bottom wall, said bottom wall having a peripheral edge and a base side wall extending from said peripheral edge of said bottom wall and terminating in a base side wall end edge, said base part further comprising a compartment wall arranged inward of said base side wall and at a distance from said base side wall with a space between said base side wall and said compartment wall;

said closure part comprises a top wall having a peripheral edge and a closure side wall, said closure side wall extending from said peripheral edge of said top wall towards said bottom wall and terminating in a closure side wall end edge;

a portion of said base side wall comprises a plurality of resiliently flexible tongues, each of said resiliently flexible tongues having a lower part at said bottom wall and an upper part, said upper part of each of said resiliently flexible tongues being inwardly deflectable in a direction towards said compartment wall;

each of said plurality of locking arrangements comprises one of said plurality of resiliently flexible tongues, a first locking member being arranged on said upper part of said resiliently flexible tongue and a second locking member being arranged on said closure part at said closure side wall end edge, said first and second locking members being mating locking members and being configured to be in mating engagement with each other in a locked configuration of said locking arrangement and to be free from engagement with each other in a release configuration of said locking arrangement, wherein said upper part of said resiliently flexible tongue is in an inwardly deflected position in relation to adjacent parts of said base side wall, and wherein said first locking member comprises a ridge extending circumferentially along said base side wall end edge with first parts of said first locking member being arranged on said resiliently flexible tongues at said upper ends of said resiliently flexible tongues and with second parts of said first locking member being arranged between said resiliently flexible tongues.

2. The snuff container according to claim 1, wherein said first and said second mating locking members comprise interengaging ridges.

3. The snuff container according to claim 2, wherein an extension of said second locking member along said closure side wall end edge is smaller than or equal to a circumferential extension of said resiliently flexible tongue.

4. The snuff container according to claim 1, wherein said snuff container comprises first and second locking arrangements forming a pair of locking arrangements, said first and second locking arrangements being placed at opposing locations along a circumference of said snuff container.

5. The snuff container according to claim 4, wherein said closure part is configured to be rotatable in relation to said base part when said snuff container is closed.

6. The snuff container according to claim 5, wherein said snuff container comprises two oppositely arranged locking arrangements and two second locking members are arranged diametrically opposite each other on the inside of said closure part and forming a pair of second locking members.

7. The snuff container according to claim 6, wherein said closure part comprises at least one auxiliary locking member and wherein said base part comprises at least one corresponding release member.

8. The snuff container according to claim 7, wherein said closure part comprises a pair of auxiliary locking members and said base part comprises a pair of corresponding release members said release members being constituted by interruptions in a first locking member.

9. The snuff container according to claim 8, wherein said release members in said first locking member and said auxiliary locking members have smaller circumferential extension than a circumferential extension of said resiliently flexible tongues.

10. The snuff container according to claim 5, wherein said closure part comprises a blocking member configured to prevent said resiliently flexible tongue from moving into said space between said base side wall and said compartment wall except when said resiliently flexible tongue has been brought into a selectable release position on said circumference of said snuff container, said selectable release position corresponding to a position of a second locking member on said closure part.

11. The snuff container according to claim 10, wherein said blocking member comprises one or more blocking flanges said blocking flanges being arranged on an inside of said top wall and extending from said inside of said top wall downward into said space between said base side wall and said compartment wall.

12. The snuff container according to claim 1, wherein a width of said resiliently flexible tongue is from 13 mm to 25 mm.

13. The snuff container according to claim 1, wherein a supplemental closure element is provided at the closure side wall end edge on the inside of the closure side wall.

* * * * *